US005404205A

United States Patent [19]

Saito

[11] Patent Number: 5,404,205

[45] Date of Patent: Apr. 4, 1995

[54] IMAGE FORMING APPARATUS WITH AN IMPROVED CLEANING MEANS

[75] Inventor: Hisahiro Saito, Hachioji, Japan

[73] Assignee: Konica Corporation, Tokyo, Japan

[21] Appl. No.: 196,642

[22] Filed: Feb. 15, 1994

[30] Foreign Application Priority Data

Feb. 18, 1993 [JP] Japan ..... 5-029310

[51] Int. Cl.[6] ..... G03G 21/00

[52] U.S. Cl. ..... 355/215; 355/296; 355/298; 355/299

[58] Field of Search ..... 355/215, 296, 298, 299, 355/297, 326 R, 327, 245; 15/93.1, 97.1, 99

[56] References Cited

U.S. PATENT DOCUMENTS

| | | | |
|---|---|---|---|
| 4,481,275 | 11/1984 | Iseki et al. | 355/299 X |
| 4,702,591 | 10/1987 | Tsuda et al. | 355/299 |
| 5,107,303 | 4/1992 | Miyamoto et al. | 355/296 |
| 5,196,892 | 3/1993 | Mitsuaki | 355/296 X |

*Primary Examiner*—A. T. Grimley
*Assistant Examiner*—Sandra L. Brasé
*Attorney, Agent, or Firm*—Frishauf, Holtz, Goodman & Woodward

[57] ABSTRACT

An image forming machine such as a copier and a printer for forming a toner image on a recording sheet. The machine includes: a photoreceptor for holding a toner image on its surface; a charger for charging the surface of the photoreceptor; a laser writing unit for exposing the surface of the photoreceptor so that a latent image is formed on the surface; a developer for developing the latent image with toner so that the toner image is formed on the surface of the photoreceptor in which the developer includes a developing sleeve for providing toner on the sleeve so that the toner is transferred from the sleeve to the surface of the photoreceptor; a transferor for transferring the toner image from the surface of the photoreceptor to the recording sheet; a cleaning unit for cleaning a residual toner on the surface after the toner image is transferred by the transferor; and an exposing unit for selectively exposing an area of the residual toner on the surface so that an electrical potential difference is created between the residual area of toner and the photoreceptor.

10 Claims, 5 Drawing Sheets

FIG. 4 (1) PATCH EXPOSURE

FIG. 4 (2) CHARGING

FIG. 4 (3) IMAGE WRITING

FIG. 6 (1) FIG. 6 (2) FIG. 6 (3) FIG. 6 (4)
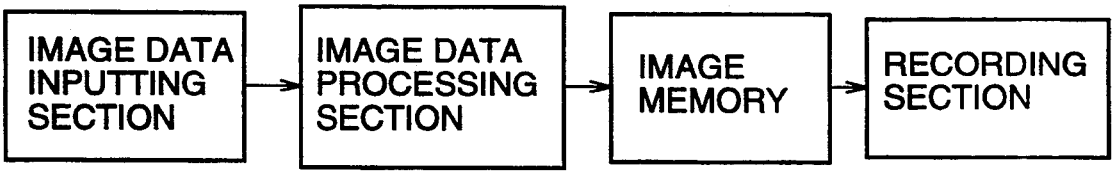

IMAGE FORMING APPARATUS WITH AN IMPROVED CLEANING MEANS

BACKGROUND OF THE INVENTION

The present invention relates to a means for preventing toner remaining on an image carrier after the image carrier is cleaned by a cleaning device of an image forming apparatus such as a copying machine or a printer.

An electrophotographic color image forming apparatus such as a copy is generally comprises a platen on which a document is placed, a scanning optical system composed of a document-illuminating lamp reciprocating under the platen, a reflection mirror, a fixed projection lens and a reflection mirror, a photoreceptor drum which is charged by a charging electrode to a certain level of voltage and rotates, a developing unit which superposes a plurality of color toners on an electrostatic latent image formed on the surface of the photoreceptor drum by the scanning optical system for developing a multicolor image, a transfer electrode which transfers a toner image onto a recording sheet that is a transfer material conveyed toward the lower part of the photoreceptor drum surface, a separating electrode and a neutralizing electrode, a fixing unit which fixes the toner image transferred onto the recording sheet, an ejecting unit for the transfer material, and a cleaning unit that removes toner and dust remaining on the photoreceptor surface after transferring.

Due to the foregoing, necessary color images are recorded in succession on transfer materials conveyed one by one intermittently along the predetermined conveyance path.

After that, the photoreceptor drum cleaned by the cleaning unit is charged through a predetermined image process to be ready for the following image forming cycle.

A cleaning blade of the cleaning unit in a color image forming apparatus is away from a photoreceptor drum while a multicolor image is being formed on the circumferential surface of the photoreceptor drum, and the blade is brought into contact with the circumferential surface of the photoreceptor drum again after the necessary color image is formed and transferred onto a transfer material for cleaning residual toner. After the cleaning blade has completed a necessary cleaning by scraping off toner, when the cleaning blade leaves the photoreceptor drum, a part of toner collected on the edge of the cleaning blade remains on the circumferential surface of the photoreceptor drum in the form of a streak.

When residual toner just adhering to the photoreceptor drum arrives at the developing unit in the course of a rotation of the photoreceptor drum, and passes through a relatively narrow gap of about 500 $\mu$ between the surface of the photoreceptor drum and a developing sleeve of each rotating developing unit, the residual toner enters the developing unit and is mixed therein. It does not cause any problem in a monochromatic image forming apparatus. In a color image forming apparatus, however, yellow toner in the developing unit, for example, is mixed with the residual toner whose color is different from that of the yellow toner, resulting in deterioration of a color tone of the yellow toner and an adverse effect on color images to be developed.

An object of the invention is to solve the problem mentioned above and to provide an image forming apparatus wherein, even when toner remains on a photoreceptor drum of a color image forming apparatus that forms multicolor images after cleaning, the toner does not enter a developing unit so that normal color images can be formed.

SUMMARY OF THE INVENTION

The object of the invention mentioned above can be attained by an image forming apparatus comprising a developing unit in which an electrostatic latent image formed on an image carrier by a charging unit and an image writing means is given toner to be developed and a cleaning means that cleans toner remaining on the image carrier after transferring, wherein a residual area of toner remaining on the image carrier after cleaning is exposed to light by an exposure means and thereby an electrical potential difference is provided between the exposed residual toner area of the image carrier and a developer carrier.

In the apparatus mentioned above, the above-mentioned image writing means can be used also for exposure for the area where toner remains after cleaning on the image carrier.

Further, in the image forming apparatus mentioned above, it is possible to provide a potential difference between an exposed image carrier and a developer carrier by exposing, with an exposure means provided between a cleaning means and a charging means before charging the image carrier, an area on the image carrier where toner remains after cleaning, and by charging the image carrier excluding the area where toner remains.

BRIEF DESCRIPTION OF THE DRAWINGS

FIGS. 6 (1)–(4) represent a block diagram showing an image forming system.

DETAILED DESCRIPTION OF THE INVENTION

Figure 1:
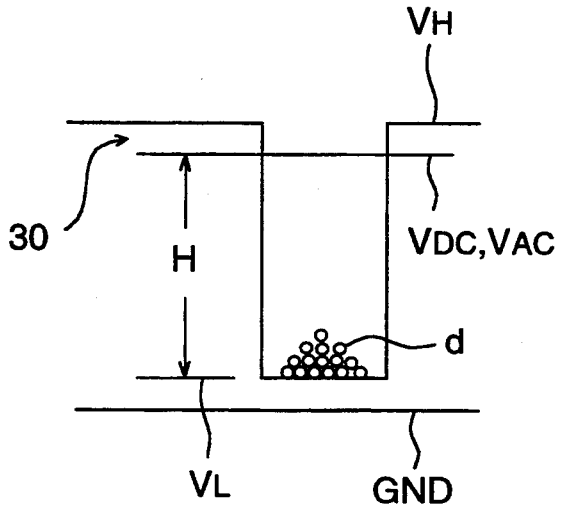
FIG. 1 represents a diagram showing how toner is held by forming a potential difference in an example of the invention.
Figure 2:
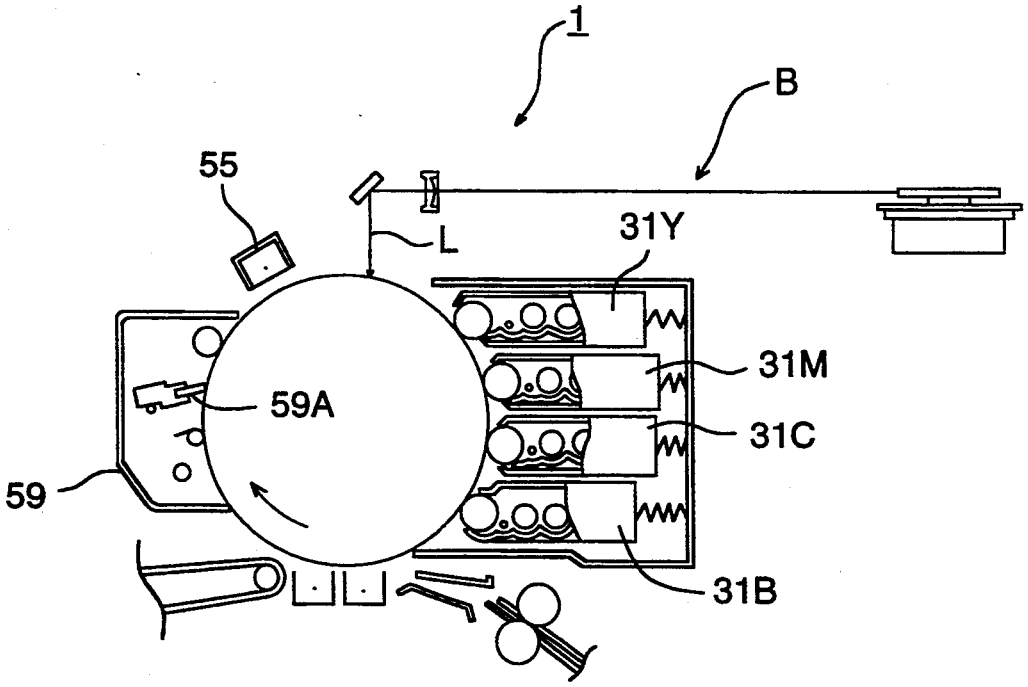
FIG. 2 is a side view showing an exposure means that forms a potential difference in an example of the invention.
Figure 3:
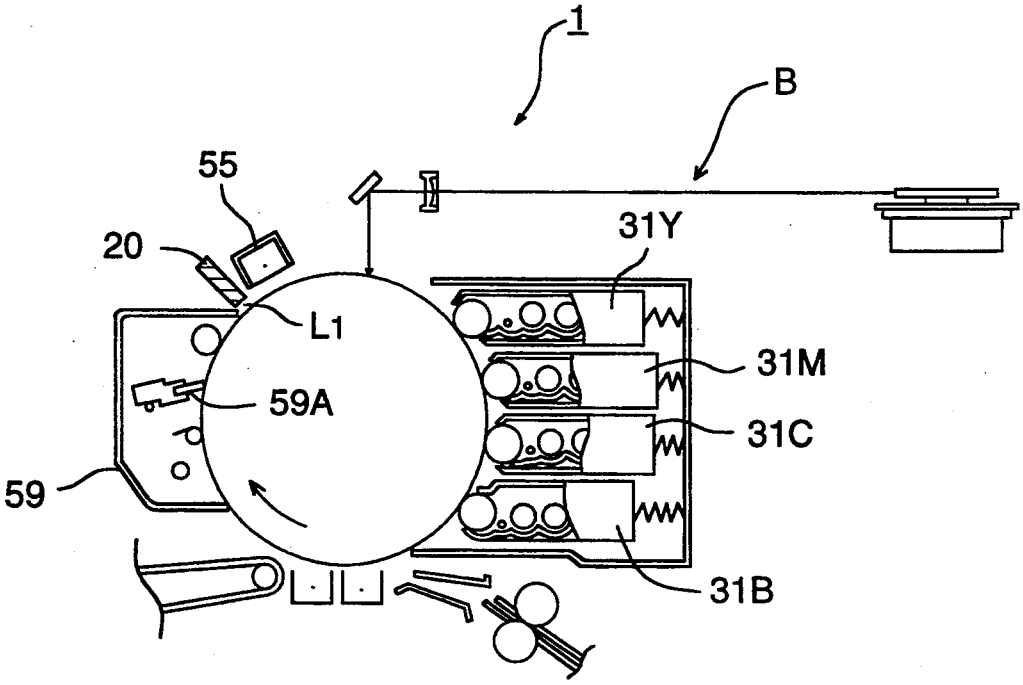
FIG. 3 is a side view showing another example of the invention.
Figure 4:
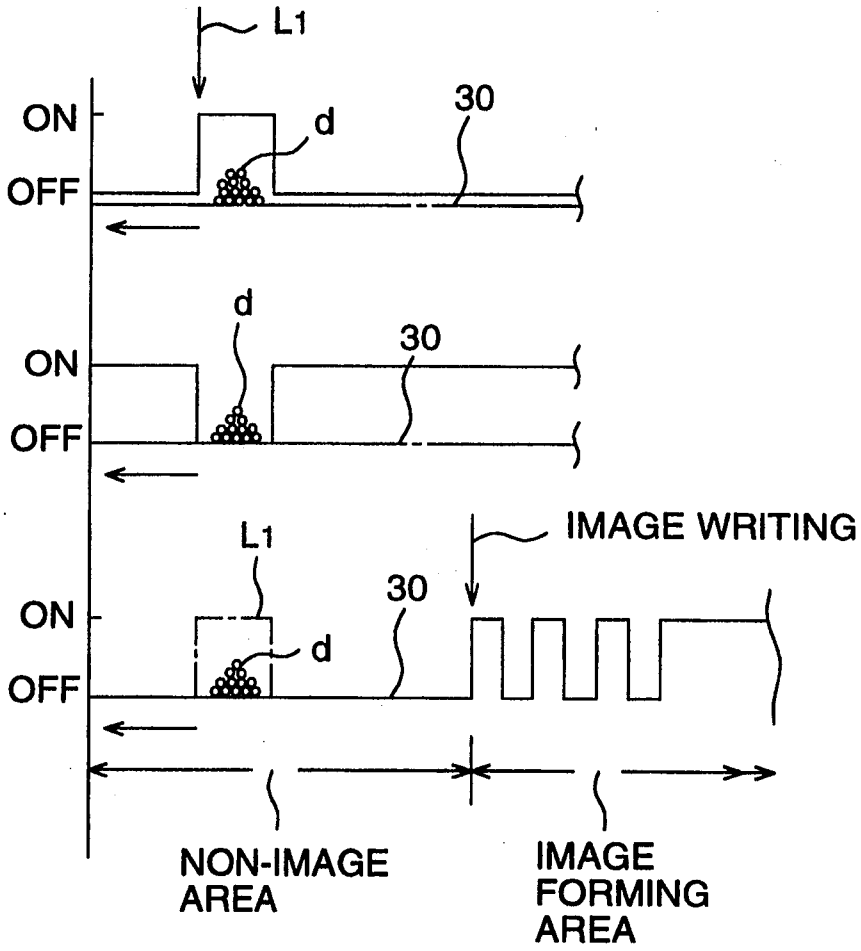
FIGS. 4 (1)–(3) represent diagrams which show respectively patch exposure, charging and image writing.
Figure 5:
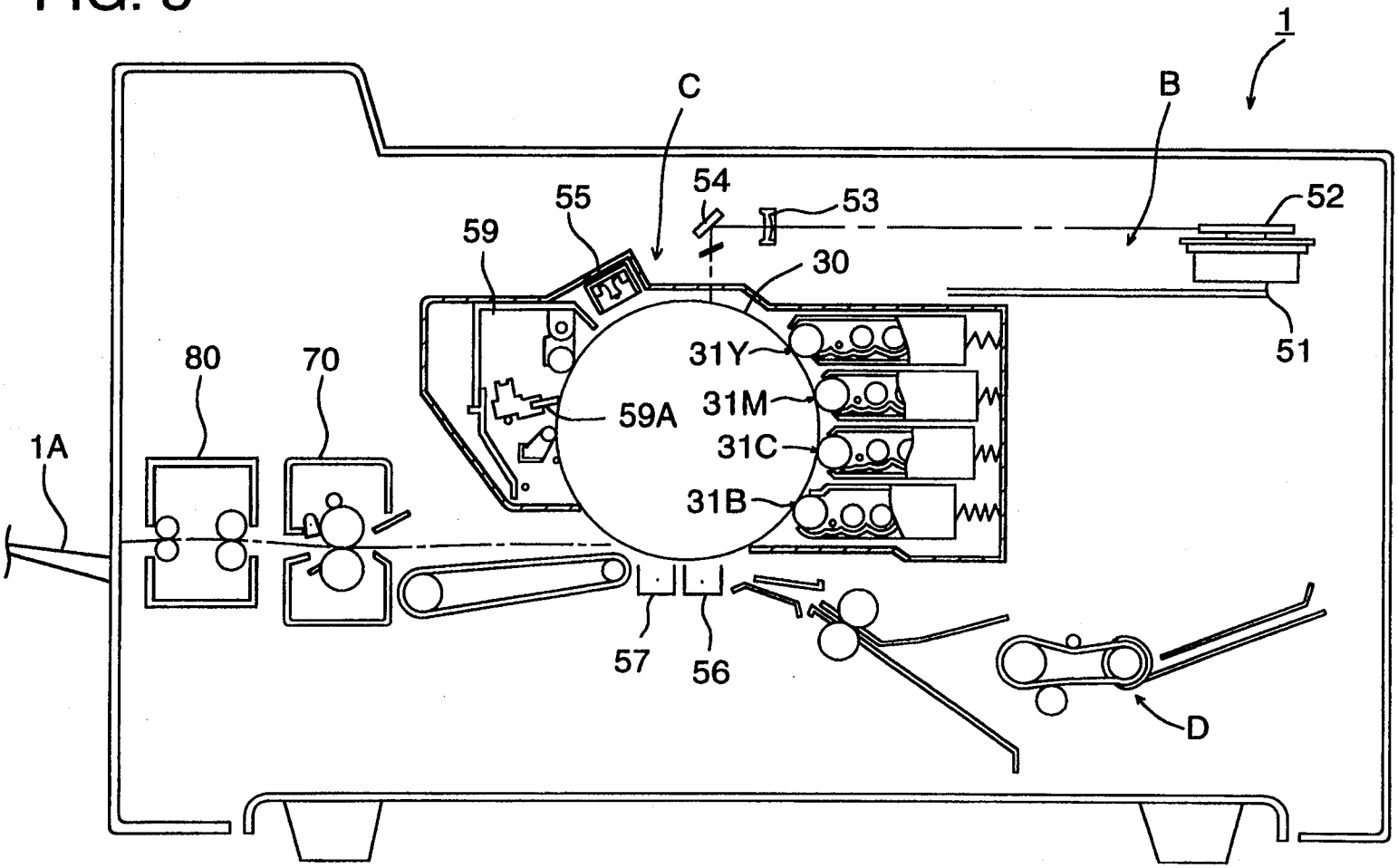
FIG. 5 is a sectional side view showing the structure of a color image forming apparatus.

An example of the invention will be explained as follows, referring to FIG. 1 representing a diagram showing how toner held by a potential difference, FIG. 2 representing a side view showing an exposure means forming a potential difference, FIG. 3 representing a side view showing another example of the invention, FIGS. 4(1)–4(3) show the states of patch exposure, charging and image writing in FIG. 3, FIG. 5 representing a sectional side view showing the structure of a color forming apparatus, and FIGS. 6(1)–6(4) show an image forming system.

The invention, however, is not limited to the present example.

An image forming apparatus of the invention will be explained as follows, referring to an example of a color printer.

As shown in FIG. 5, color image forming apparatus 1 comprises laser-writing unit B, image forming section C and sheet-feeding section D so that a color image can be recorded through the following process. Formation of a multicolor image in the present example, to start with, is carried out in accordance with an image forming system shown in FIG. 6. Namely, data obtained in a color image data input section (FIG. 6 (1)) where an original image is scanned by an image sensor are subjected to arithmetic processing in a data processing section (FIG. 6 (2)) for preparing image data which are stored in an image memory (FIG. 6 (3)) temporarily. Then, the image data in the image memory are taken out in the course of recording and are inputted, for example, in color image forming apparatus 1 shown in FIG. 5 that is a recording section (FIG. 6 (4)). Namely, when color signals outputted from an image reading unit that is separate from the above-mentioned printer are inputted in laser-writing unit B, a laser beam generated by a semiconductor laser (not shown) is subjected to rotary scanning by means of polygon mirror 52 rotated by driving motor 51, its optical path is deflected by mirror 54 through a lens and is projected on the circumferential surface of photoreceptor drum 30 that is an image carrier and is charged uniformly in advance to a certain predetermined electric charge by charging unit 55 that is a charging means, and a bright line is formed.

On the other hand, an index (not shown) provided at a specific position on photoreceptor drum 30 with respect to the secondary scanning direction is detected by a photosensor (not shown), and then the signals thus detected and used as a reference to start modulation of a semiconductor laser made by image signals, and thus the primary scanning direction is determined. After the start of scanning, a laser beam (not shown) is detected by an index sensor (not shown) with respect to the primary scanning direction, and a laser beam thus modulated scans the surface of the photoreceptor drum 30. Therefore, the primary scanning by means of the laser beam and the secondary scanning by means of rotation of the photoreceptor drum 30 form a latent image corresponding to the first color on the surface of the photoreceptor drum 30. This latent image is developed by developing unit 31Y containing yellow (Y) toner (image-visualizing medium), for example, in a plurality of developing units provided in parallel in the present example, and thus, a Y toner image is formed on the surface of the photoreceptor drum 30. The toner image thus obtained passes, while being held on the photoreceptor drum 30, through cleaning unit 59 that is a cleaning means being away from the surface of the photoreceptor drum 30 to enter the copy cycle for the second color.

Namely, the photoreceptor drum 30 on which a Y toner image is formed is charged again by the above-mentioned charging unit 55, and then signals of the second color outputted from the image reading unit are inputted in the above-mentioned writing unit B, and thus writing on the surface of the photoreceptor drum 30 is conducted in the same way as in the occasion for the signals for the first color mentioned above, for forming a latent image. This latent image is developed by developing unit 31M containing magenta (M) toner as the second color, for example. The M toner image is formed on the above-mentioned Y toner image which has already been formed.

In the same manner as the foregoing, a latent image formed through the third image signals is developed by developing unit 31C containing cyan (C) toner, and then, after charging again, a latent image formed through the fourth image signals is developed by developing unit 31B containing black (B) toner, and thus, the C toner image and the B toner image are superimposed on the circumferential surface of the photoreceptor drum 30 to form a color toner image on the surface of the photoreceptor drum 30.

On each of sleeves of the developing units 31Y, 31M, 31C and 31B, there is impressed an A.C. bias voltage or further a D.C. bias voltage so that the photoreceptor drum 30 whose base is grounded may be subjected to reversal development (jumping development) in a non-contact manner. Incidentally, in a developing unit which is out of developing operation, its developing sleeve stops rotating and a bias voltage to be impressed is cut so that toner images formed on the photoreceptor drum 30 may not be damaged and unnecessary toner may not be supplied to a latent image.

The color toner image formed on the circumferential surface of the photoreceptor drum 30 in the manner mentioned above is transferred, at transfer electrode 56 provided as a transfer means, onto a transfer material representing a recording medium that is fed out from the above-mentioned sheet-feeding section D by a sheet-feeding belt and synchronized with the above-mentioned color toner image by a timing roller. For this transferring, the transfer electrode 56 impresses high voltage from a high voltage power source having a polarity opposite to that of the toner.

Thus, the transfer material onto which the color toner image has been transferred is separated from the surface of the photoreceptor drum 30 by separating electrode 57, and then is conveyed into fixing unit 70 by a conveyance belt, for fixing of the color toner image. After the fixing is completed, the transfer material is conveyed to sheet-ejecting unit 80 to be ejected onto tray 1A.

On the other hand, the photoreceptor drum 30 from which the color toner image has been transferred to the transfer material and also the transfer material has been separated, further rotates clockwise so that residual toner on the photoreceptor drum 30 may be removed for cleaning by blade 59A of cleaning unit 59 that is in pressure contact with the photoreceptor drum 30. After cleaning is completed, the blade 59A leaves the photoreceptor drum 30 again for the following process of color image forming.

Thus, desired color images are recorded on the transfer material.

Next, there will be explained a potential difference forming means of the invention that forms a potential difference between a photoreceptor drum and a developing sleeve so that a toner image can be held on the photoreceptor drum.

The photoreceptor drum 30 which has been cleaned is charged again in a predetermined image forming process. An exposure means for an area on the circumferential surface of the photoreceptor drum 30 where toner stays even after cleaning employs a laser beam of laser writing unit B as shown in FIG. 2. Namely, the same exposure means is used both for the area of residual toner d and for forming images, and the same laser exposure L is used for the area of residual toner d prior to the laser exposure L for image forming. Therefore, the details of the exposure means in the present example shown in FIG. 2 are the same as those shown in FIG. 5, and explanation thereof is omitted accordingly.

As shown in FIG. 1, $V_H$ represents a charging voltage impressed on photoreceptor drum 30, $V_{DC}$ represents D.C. components of a developing bias voltage, $V_{AC}$ represents A.C. components of the same, and $V_L$ represents an exposure voltage. The charging voltage $V_H$ is set to a range from −500V to −900V and preferably to −650V. $V_{DC}$ representing D.C. components of a developing bias voltage is set to a range from −400V to −800V and preferably to −500V, while A.C. component superimposed on D.C. component is set to a range of 2–3 KV and preferably to 2.8 KV.

Exposure voltage $V_L$ is set to a range from 0V to −300V and preferably to −200V. An amount of electric charges of toner to be used is within a range from −10 μC/g to −30 μC/g and preferably within a range from −15 μC/g to −20 μC/g.

As shown in FIG. 1, there is formed potential difference H between developing bias voltage $V_{DC}$ as well as $V_{AC}$ with a base of GND (ground) and exposure voltage $V_L$, due to laser exposure L. Therefore, in case of reversal development, it becomes easy by the developing bias for toner having an amount of electric charges ranging from −10 μC/g to −30 μC/g to fly electrically toward the surface of the photoreceptor drum 30, the potential of which is lowered by the exposure.

Residual toner d stuck to the circumferential surface of the photoreceptor drum 30 due to potential difference H thus formed arrives at developing unit 31Y shown in FIG. 2 when the photoreceptor drum 30 rotates in the arrowed direction. Then the residual toner passes through the developing sleeve that is rotating while being away from the circumferential surface of the photoreceptor drum 30 by about 500 μ. It is possibly happened that toner is flown and adhered by the developing bias to the location where the residual toner d occurs; however, the toner in not flown back to the developing sleeve. Therefore, the residual toner does not enter the developing unit 31Y. In the same way, the residual toner d passes through developing sleeves of developing units 31M, 31C and 31B located at the downstream side of the developing unit 31Y to be adjacent thereto while the residual toner is sticking, and then arrives at transfer electrode 56. Since the residual toner d is sticking to a non-image area of the photoreceptor drum 30, it is not transferred onto the transfer material, and the photoreceptor drum 30 is cleaned by cleaning unit 59 again after color images on the photoreceptor drum have been transferred. Since the residual toner is usually the mixture of Y.M.C.B. toners, especially in case that the residual toner enters the developing unit 31Y, it is impossible to form a normal Y toner image.

Therefore, by using the aforementioned method, excellent color images can be recorded constantly in a way that no toners enter developing units 31Y, 31M, 31C and 31B and no color images transferred are affected.

Next, another example to cause residual toner d to be stuck to the photoreceptor drum 30 by forming a potential difference will be explained as follows, referring to FIG. 3 and 4.

As shown in FIG. 3, there is provided patch exposure light source 20 such as, for example, LED or a tungsten lamp which exposes an area of residual toner d at the location over cleaning unit 59 and before charging unit 55 at the downstream side in the arrowed direction of rotation of the photoreceptor drum 30. The patch exposure light source 20 is also used for removal of residual electric charges on the photoreceptor drum 30. Exposure voltage $V_L$ of the patch exposure light source 20 to be charged is the same exposure voltage $V_L$ as that of laser exposure L in the aforementioned example. An area of residual toner d on the circumferential surface of the cleaned photoreceptor drum 30 is subjected to patch exposure $L_1$ made by the patch exposure light source 20, resulting in exposure voltage $V_L$ identical to that in the aforementioned example, for example, a voltage of −200. Thus, potential difference H is formed between a developing sleeve whose developing bias voltage $V_{DC}$ and $V_{AC}$ are set to the values identical to those in the above-mentioned example. This patch exposure $L_1$ is arranged to expose at an arbitrary position between the cleaning unit 59 and the charging unit 55.

As stated above, charging voltage $V_H$ to be impressed on the photoreceptor drum 30, developing bias voltage D.C. component $V_{DC}$ and A.C. component $V_{AC}$, and a value of electric charges amount of toner μC/g are all set to be exactly the same as those in the example stated previously.

An upper portion of FIG. 4 (1) shows the state of ON and OFF of patch exposure $L_1$ wherein patch exposure $L_1$ is ON for exposure for the area of residual toner d and OFF for other area. A middle portion of FIG. 4 (2) shows the state of ON and OFF of charging unit 55 for the photoreceptor drum 30 wherein the photoreceptor drum 30 that rotates in the arrowed direction after cleaning is subjected to charging in accordance with a predetermined image forming process, and when the area of residual toner d which has been subjected to patch exposure L1 arrives at charging unit 55, the charging unit 55 is turned off and an uncharged area is formed. A lower portion of FIG. 4 (3) shows the state of image writing made by laser writing unit B for the upper and middle portions. Incidentally, residual toner d stays at a non-image area as shown in the figure.

Since no charging is conducted on an area of residual toner d, patch exposure L1 is carried out and potential difference H identical to that in the example mentioned above is formed and kept, and thus, residual toner d passes through developing sleeves of developing units 31Y, 31M, 31C and 31B in the same manner as in the foregoing while being stuck to the photoreceptor drum 30 through adhesive power of a predetermined value. Therefore, residual toner d does not enter any of the developing units 31Y, 31M, 31C and 31B and is removed by cleaning unit 59 after an aimed color image has been transferred.

Turning on and off for the patch exposure light source 20 and the charging unit 55 as mentioned above are carried out through the control stored in a CPU (not shown) in advance.

Due to the potential difference formed by an exposure means or a charging means between a photoreceptor drum and a developing sleeve in the invention, residual toner staying on the photoreceptor drum even after cleaning is stuck to the photoreceptor drum through adhesive power, being prevented from entering the developing units. Therefore, the color tone of color toner in the developing unit is not disturbed and excellent color images are recorded on a transfer material constantly.

What is claimed is:

1. An image forming apparatus, comprising:

cleaning means for cleaning the surface of an image carrying member with a cleaning member;

means for contacting said cleaning member with said image carrying member and for releasing said cleaning member from said image carrying member;

charging means for charging the surface of said image carrying member;

writing means for exposing the surface of said image carrying member so as to form a latent image thereon;

developing means for developing said latent image so as to form a toner image on said image carrying member; and means for forming a potential difference between an area of a residual toner accumulated at a moment of releasing said cleaning member from said image carrying member and another area of the surface of said image carrying member, wherein said potential difference prevents said residual toner from transferring to said developing means.

2. The apparatus of claim 1, wherein said cleaning member comprises a cleaning blade.

3. The apparatus of claim 1, wherein said potential difference forming means comprises a light exposing means.

4. The apparatus of claim 3, wherein said light exposing means selectively exposes said area of said residual toner.

5. The apparatus of claim 3, wherein said light exposing means and said writing means comprises a common light source.

6. The apparatus of claim 1, wherein said potential difference forming means comprises said charging means.

7. The apparatus of claim 6, wherein said charging means selectively charges said another area of the surface of said image carrying member.

8. The apparatus of claim 1, wherein said potential difference forming means comprises a light exposing means and said charging means.

9. The apparatus of claim 8, wherein:

said light exposing means selectively exposes said area of said residual toner; and said charging means selectively charges said another area of the surface of said image carrying member.

10. A color image forming apparatus, comprising:

cleaning means for cleaning the surface of an image carrying member with a cleaning member;

means for contacting said cleaning member with said image carrying member and for releasing said cleaning member from said image carrying member;

charging means for charging the surface of said image carrying member;

writing means for exposing the surface of said image carrying member so as to form a latent image thereon;

plurality of developing means for developing said latent image so as to form a toner image on said image carrying member;

control means for controlling said image carrying member, said charging means, said writing means and said plurality of developing means so that plural color toner images are superimposed on said image carrying member; and means for forming a potential difference between an area of a residual toner accumulated at a moment of releasing said cleaning member from said image carrying member and another area of the surface of said image carrying member, wherein said potential difference prevents said residual toner from transferring to said plurality of developing means.

* * * * *